US005148220A

United States Patent [19]

Hilbert et al.

[11] Patent Number: 5,148,220

[45] Date of Patent: Sep. 15, 1992

[54] TONING STATION DRIVE FOR IMAGE-FORMING APPARATUS

[75] Inventors: Thomas K. Hilbert, Spencerport; James R. Carey, Rochester, both of N.Y.

[73] Assignee: Eastman Kodak Company, Rochester, N.Y.

[21] Appl. No.: 712,225

[22] Filed: Jun. 7, 1991

[51] Int. Cl.[5] ..... G03G 15/06

[52] U.S. Cl. ..... 355/245; 74/810.1; 355/326

[58] Field of Search ..... 355/210, 211, 200, 245, 355/251, 326, 327; 118/645; 74/810.1

[56] References Cited

U.S. PATENT DOCUMENTS 4,775,875 10/1989 Hull et al. ..... 355/326
4,970,561 11/1990 Mizuno ..... 355/326

FOREIGN PATENT DOCUMENTS 56-76760 6/1981 Japan ..... 74/810.1
59-194154 11/1984 Japan ..... 74/810.1

*Primary Examiner*—Joan H. Pendegrass
*Assistant Examiner*—Shuk Y. Lee
*Attorney, Agent, or Firm*—Leonard W. Treash, Jr.

[57] ABSTRACT

An image-forming apparatus, for example, a color electrophotographic apparatus, includes two development stations. Each development station includes an applicator with a rotatable component which moves developer into toner-applying relation with an electostatic image carried on an image member. The two rotatable components are driven by a single motor selectively according to whether the motor is driven in a forward or reverse direction. A one-way clutch in the drive train of each rotary component prevents rotation of that component when the other station's rotary component is being driven.

7 Claims, 6 Drawing Sheets 10
7
281
81
8
282
82
47
46
40
41
42
241
245
246
243
244
252
259
242
253
247
249
248
251

TONING STATION DRIVE FOR IMAGE-FORMING APPARATUS

RELATED APPLICATIONS

This application is related to co-assigned:

U.S. patent application Ser. No 07/711,839 filed Jun. 7, 1991, IMAGE FORMING APPARATUS HAVING AT LEAST TWO TONING STATIONS, in the name of Hilbert et al.

U.S. patent application Ser. No. 07/712,227 filed Jun. 7, 1991, TONING STATION FOR SELECTIVELY APPLYING TONER TO AN ELECTROSTATIC IMAGE, in the name of Westbrook et al.

U.S. patent application Ser. No. 07/712,022 filed Jun. 7, 1991, IMAGE FORMING APPARATUS HAVING A MAGNETIC BRUSH TONING STATION, in the name of Hilbert et al.

TECHNICAL FIELD

This invention relates to the toning of electrostatic images. It is particularly useful in applying toners of different colors selectively to different electrostatic images.

BACKGROUND ART

U.S. Pat. No. 4,970,561 to Mizuno, issued Nov. 13, 1990, shows a multicolor image forming apparatus in which a pair of toning stations are positioned alongside each other. Electrostatic images are formed on an image member and one or the other of the two stations is moved into position to tone each image. The apparatus includes a mechanism for moving one station into position and retracting the other simultaneously and vice versa. The drive mechanism for each station is engaged and disengaged according to which station is in position to tone the electrostatic image. The system is clutched by movement of the stations and does not require a separate clutch mechanism.

Recently, devices have been proposed in which toning stations do not have to be moved into and out of operative position with respect to an image member to control toning of an electrostatic image in a color apparatus. For example, U.S. Pat. No. 4,671,207 to T. K. Hilbert, Jun. 9, 1987; U.S. Pat. No. 4,690,096 to Hacknauer et al, issued Sep. 1, 1987; and U.S. Pat. No. 4,748,471 to Adkins, issued May 31, 1988, show a toning station which includes an applicator associated with an image member, which applicator is maintained in position to tone an electrostatic image. A transport device transports toner from a mixing device in a sump to the applicator when an image is being toned. The transport device includes a gating mechanism which terminates the flow of such developer when no image is being toned so that that image can be toned by another station without interference from this station. With this structure, the toning station can remain in a single location throughout use of the apparatus, greatly simplifying its construction. See also, U.S. Pat. Nos. 4,716,437 and 4,707,107.

Because some toner remains in the vicinity of the applicator when developer flow has been shut off, it is preferable in such structures to stop the rotation of the applicator when that station is not toning. This can be accomplished when using a single motor to drive two or more applicators, but it requires a separate clutching mechanism for each applicator. A more common solution is to use a separate motor for each applicator, which motor is turned on and off with the adjustment of the gating mechanism.

DISCLOSURE OF THE INVENTION

It is an object of the invention to simplify the structure of developer stations in which one or the other, but not both, of two applicators are driven at a time.

This and other objects are accomplished by an image-forming apparatus which includes first and second development stations having first and second applicators, respectively. A reversible motor is connected to both applicators through a connecting means which drives the first applicator when the motor is driven in a first direction and the second applicator when the motor is driven in a second direction, reverse of the first direction.

According to a preferred embodiment each applicator is connected to the motor through a one-way clutch which transmits driving torque from the motor in a direction applying developer to an electrostatic image and does not transmit driving torque to the applicator in the opposite direction.

According to a further preferred embodiment, a drive gear is directly driven in both forward and reverse directions by the motor. The drive gear is connected directly to a driven gear coaxial with the first applicator, which drives that applicator through a one-way clutch. The drive gear is connected through an idler gear, which reverses the torque direction, to a second driven gear coaxial with the second applicator which, in turn, drives the second applicator through a one-way clutch.

With this structure, a single motor can be used to drive both applicators, and selection between the applicators is made merely by reversing the motor. The one-way clutches are available inexpensive components.

BEST MODE OF CARRYING OUT THE INVENTION

Figure 1:
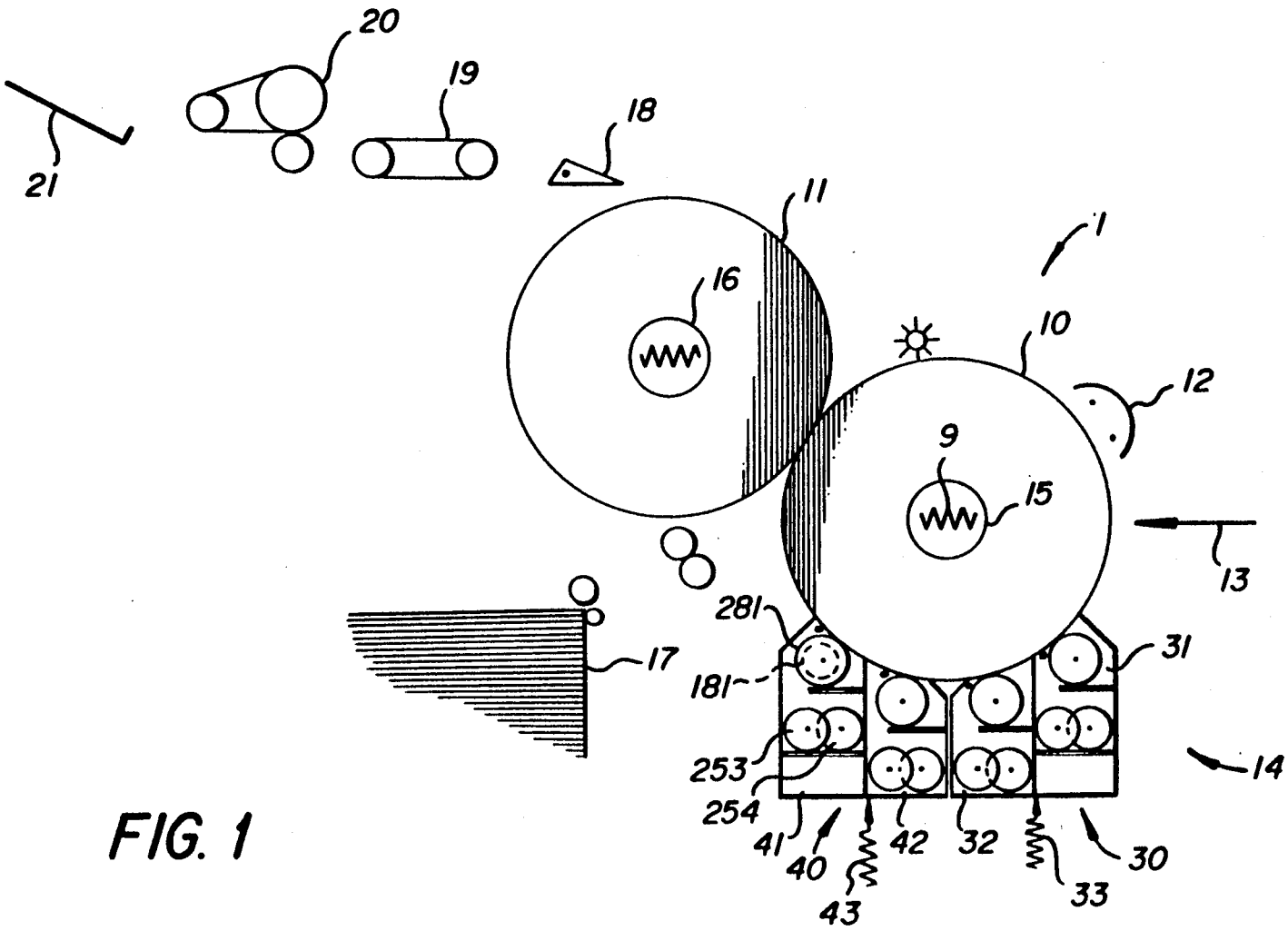
FIG. 1 is a front schematic of a multicolor image-forming apparatus with the insides of certain components shown schematically.

The invention is particularly usable in a multicolor image-forming apparatus similar to that shown in FIG. 1. According to FIG. 1, a multicolor image-forming apparatus 1 includes an image member 10 which can be a metallic drum having appropriate photoconductive and other layers for forming electrostatic images, all as is well known in the art. Image member 10 could also be a photoconductive or dielectric web wrapped entirely or partially around a cylindrical drum. The image member 10 defines an image surface on which electrostatic images are formed.

Drum-shaped image member 10 is rotated by means not shown past a series of stations which include a charging station 12, which applies a uniform charge to the image surface. The charged image surface is exposed by an exposure station, for example, a laser exposure station 13 to create a series of electrostatic images. Those images are toned by a cluster 14 of toning stations. Cluster 14 contains four stations 31, 32, 41 and 42, each of which contain a different color toner. Each electrostatic image is toned by one of said stations to create a single color toner image. A series of images can be toned by different stations to create a series of different color toner images.

Each different color toner image is transferred to a receiving sheet carried by a transfer drum 11 and fed from a receiving sheet supply 17. The receiving sheet is held to transfer drum 11 by conventional means, for example, vacuum holes, holding fingers or electrostatics, not shown. To form multicolor images, each of the single color images of a series is superposed in registration on the receiving sheet as transfer drum 11 repeatedly rotates the receiving sheet through a nip with image member 10.

Conventionally, transfer would be accomplished by an electrostatic field. However, for highest quality work, transfer drum 11 is heated by an internal heat source 16 sufficiently to sinter toner in the toner image. Sintered toner has a tendency to stick to the receiving sheet, thereby transferring. This process can be assisted by a moderate heating of image member 10 using a lamp 15. It can also be assisted using a receiving sheet with a heat softenable outer layer, which layer is softened by the temperature of drum 11 and which contacts the toner image.

After the desired number of images are transferred in registration to the receiving sheet, it is separated from drum 11 by a separating pawl 18 which moves into engagement with drum 11 for this purpose. The receiving sheet is transported by a conventional transport means 19 to a fixing device 20 and then to an output tray 21.

Cluster 14 includes four toning or development stations divided into two toning units 30 and 40. Unit 30 includes stations 31 and 32, while unit 40 includes stations 41 and 42. The cluster 14 is symmetrical about a plane between stations 32 and 42, which plane contains an axis of rotation 9 of image member 10. Each of the units 30 and 40 are not symmetrical themselves, as is evident from FIG. 1. However, they are mirror images of each other and, thus, can be built with the same housing parts.

Each of units 30 and 40 is separately mountable in apparatus 1 as a unit. Each unit is loaded in the apparatus by moving it in a direction generally parallel to axis 9 to a position below its position shown in FIG. 1. The unit is then raised by a lifting mechanism, shown in FIG. 4, into operative position with respect to image member 10 where the lifting mechanism resiliently urges it into a position controlled by appropriate spacing means to be described with respect to FIG. 4.

Figure 3:
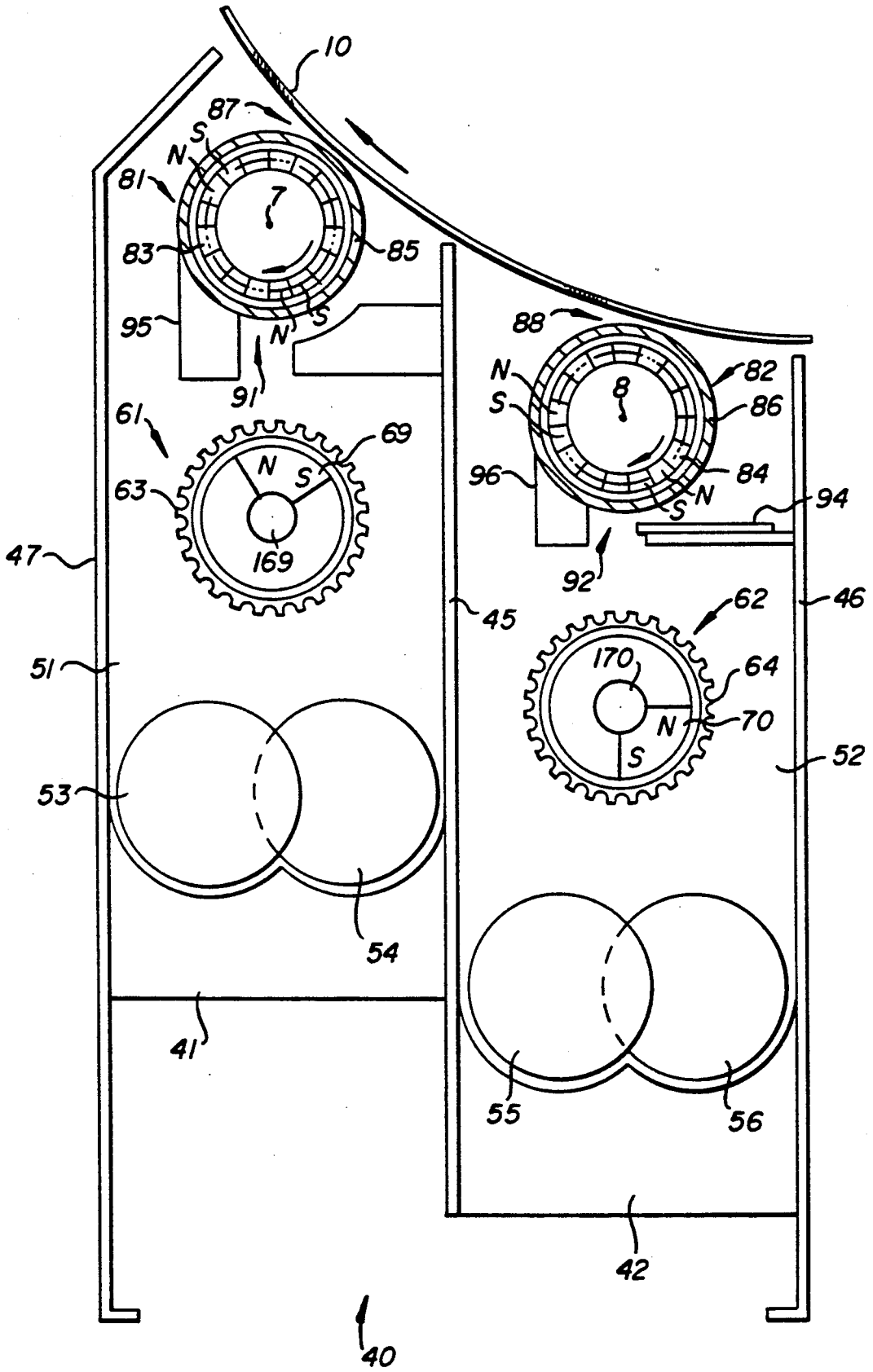
FIG. 3 is a side section of a toning unit usable in the apparatus shown in FIG. 1 and illustrating the developer handling function of the unit.

The inner workings of the toning stations are somewhat different between the embodiments shown in FIGS. 1 and 3. Referring first to the embodiment shown in FIG. 3, toning unit 40 includes a first toning station 41 and a second toning station 42. Toning unit 40 is of a single unitary construction defining development chambers 51 and 52 for both stations. Thus, stations 41 and 42 have a common center wall 45 and external side walls 46 and 47. Unitary end walls, not shown, can further define both stations.

Within each of development chambers 51 and 52 are mounted a pair of mixing devices, for example, paddle mixers 53 and 54 and 55 and 56, respectively, which can be constructed according to the teachings of U.S. patent application Ser. No. 07/451,853, filed Dec. 18, 1989, in the name of T. K. Hilbert. Mixing devices 53–56 are in the bottom of developer sumps forming the bottom of chambers 51 and 52. They are rotated rapidly to thoroughly mix a two-component developer and raise the level of the developer until it comes under the influence of developer transport devices 61 and 62 in each station.

Developer transport devices 61 and 62 include rotatable transport rollers 63 and 64, respectively, each of which have an outer fluted surface for transporting developer.

At the top of stations 41 and 42 are applicators 81 and 82, respectively. Each applicator includes a rotatable magnetic core 83 and 84 and a non-magnetic sleeve 85 and 86. As seen in FIG. 3, magnetic cores 83 and 84 are rotatable in a clockwise direction which causes developer having a magnetic component to move in a counterclockwise direction around sleeves 85 and 86. This type of applicator can be used with single-component magnetic developer or conventional two-component developer having a magnetic carrier. However, it is preferably used with a two component developer having hard magnetic carrier and a non-magnetic toner such as that described in U.S. Pat. No. 4,546,060, Miskinis et al, issued Oct. 8, 1985; U.S. Pat. No. 4,473,029, Fritz et al, issued Sep. 25, 1984; and U.S. Pat No. 4,531,832, Kroll et al, issued Jul. 30, 1985. With such developer, rapid rotation of cores 83 and 84 causes the developer to move around sleeves 85 and 86 in a direction opposite to the direction of rotation of the core, bringing the developer through development or toning positions 87 and 88 between sleeves 85 and 86 and the image surface of image member 10. Flow of developer around sleeves 85 and 86 can also be affected by rotation of sleeves 85 and 86 in either direction, as is well known in the art. In the FIG. 3 embodiment the sleeves do not rotate and the entire movement of the developer is driven by cores 83 and 84. In the FIG. 6 embodiment, the sleeve is rotated with the flow of developer.

Flow of developer from the bottom or sump portion of chambers 51 and 52 is controlled by several means. Developer above mixers 53–56 is attracted to transport rollers 63 and 64 by magnetic gates 69 and 70. As shown with respect to station 42, developer above mixers 55 and 56 is attracted into contact with roller 64 by magnetic gate 70. Rotation of roller 64 brings the developer held by gate 70 up to the top of transport device 62 where it is attracted by core 84 in applicator 82. With magnetic gate 70 in the position shown with respect to toning station 42, station 42 is applying developer to an electrostatic image passing through toning position 88 on the image surface of image member 10.

As shown with respect to station 41, magnetic gate 69 has been rotated until it is facing applicator 81. In this position no developer is attracted to the transport roller 63, and developer is inhibited from leaving the top of transport device 61, thereby shutting off the supply of developer to applicator 81 to prevent toning by toning station 41 of an electrostatic image passing through development position 87. This structure, merely by the rotation of magnetic gate 69, controls whether or not station 41 applies toner to a passing electrostatic image. The stations do not need to be moved into and out of toning position between images.

Developer leaving transport roller 64 passes through an opening 92 associated with applicator 82 which assists in metering the amount of toner moved by applicator 82. As shown with respect to toning station 42, opening 92 can be given a factory or field adjustment in size by moving a sliding plate 94. With respect to toning station 41, the comparable opening 91 is shown permanently formed. Obviously, in commercial use both stations would have the same structure. They are shown different in FIG. 3 only to illustrate some of the variations possible.

Developer leaving developing positions 87 and 88 is separated from sleeves 85 and 86 by skives 95 and 96. As seen with respect to toning station 41, skive 95 and opening 91 can be defined by substantially the same element positioned and attached to center wall 45.

The above described developer gating system is an improvement of apparatus shown and described in U.S. Pat. No. 4,748,471, cited above, the disclosure of which is incorporated by reference herein. See also, U.S. Pat. Nos. 4,956,674 and 4,716,437.

Figure 6:
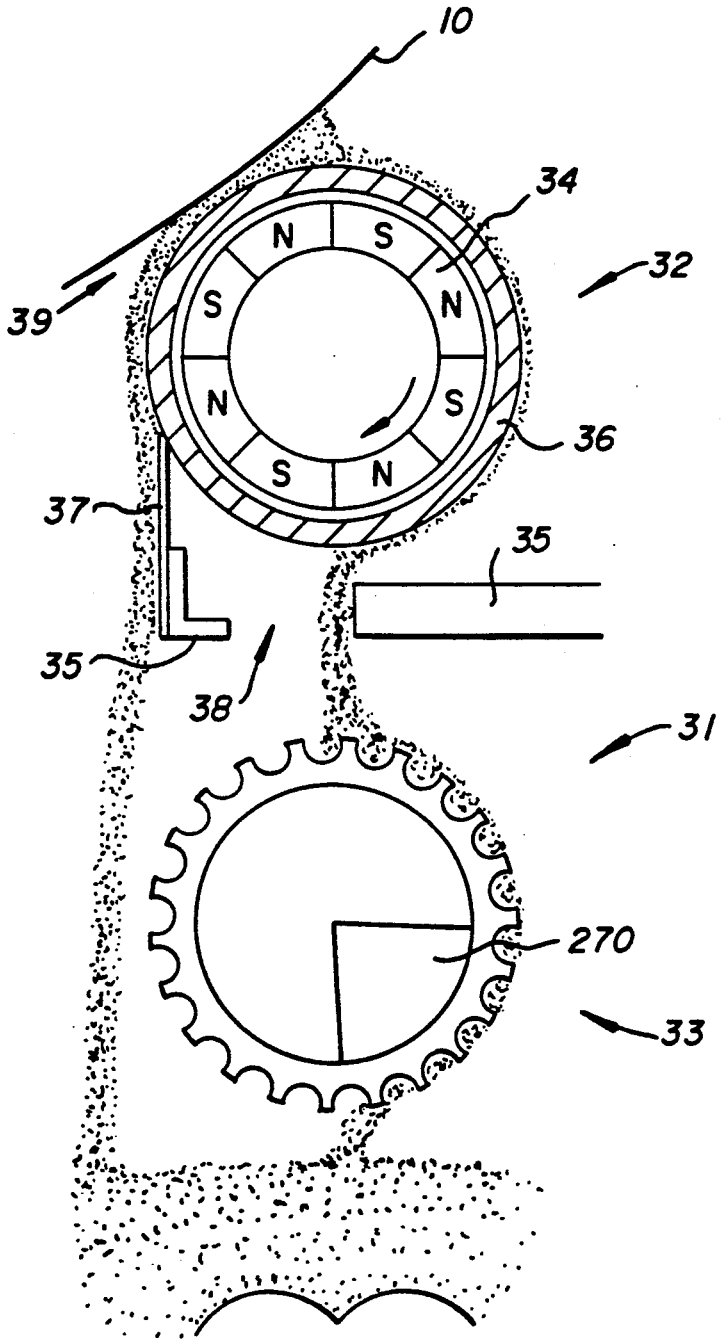
FIG. 6 is a schematic side section similar to FIG. 3 illustrating, with respect to a different one of the toning stations, the operation of a skive or wiper preferably employed in all toning stations.

FIG. 6 best illustrates another aspect interior to each of the toning stations in cluster 14. For reasons which will become apparent, this is illustrated with respect to station 31. According to FIG. 6, developer in station 31 is transported by a transporter 33 controlled by a gate 270 into the magnetic field of a rotating magnetic core 34 in the same manner as described with respect to stations 41 and 42 and shown in FIG. 3. Developer is attracted by core 34 through an opening 38 and into contact with a sleeve 36. Unlike the FIG. 3 embodiment, in the FIG. 6 embodiment the sleeve is rotatable in a counterclockwise direction which supplements the effect of the clockwise rotation of core 34 on the hard carrier particles in the developer.

However, as in the FIG. 3 embodiment, the developer is moved primarily by the rotation of core 34 from an upstream position adjacent or opposite opening 38 through a toning position 39. As described in U.S. Pat. No. 4,546,060, Miskinis et al, the rapid rotation of the core causes a rapid tumbling of the carrier because of the carrier's high coercivity. The outside surface of sleeve 36 can be somewhat roughened. The tumbling of the carrier aided by the roughened surface causes the developer to move relative to the roughened surface. The tumbling of the carrier also greatly enhances the development of the image in the toning position 39, as explained in the Miskinis et al patent.

After the developer leaves the toning position 39 between sleeve 36 and image member 10, it is starved of toner and is recirculated to the body of developer below transport 33 for remixing as described with respect to FIG. 3. To remove developer from sleeve 36 it is skived by a blade shaped skive or wiper 37, spring urged against sleeve 36 at a position downstream from toning position 39. Skive 37 is held by a support 35 which can also define opening 38.

This structure is designed for high quality color imaging, for example, imaging with high resolution, small spherical color toners in the 3 to 5 micron size range. In using this structure with also small spherical hard magnetic carrier particles (for example, carrier particles in a size range between 20 and 40 microns), a problem with the traditional skive 37 developed. Spent, toner-starved developer accumulated around the point of contact between the skive 37 and the sleeve 36. Because of the orientation of station 31 (compared to the other stations), skive 37 is very close to image member 10. As starved developer backs up from skive 37 it interferes with the image leaving the toning position. Carrier in this area has a tendency to be carried away by image member 10 creating well known problems downstream. Moreover, starved carrier buildup reduces the density of the image. Of most importance, the buildup has a tendency to remain after the station has been turned off. That buildup then may inadvertently apply toner of the wrong color to an image to be toned by a downstream station.

To increase developer flow along the blade or skive 37, a size 400 grit is applied to the left surface of the skive 37. This roughens the surface which causes the carrier particles which are still tumbling under the influence of core 34 to table down the skive and away from image member 10. This aspect is illustrated in FIG. 6 with respect to station 31 in which the skive is closest to image member 10. However, the skives shown in FIG. 3 are also roughened to facilitate flow of developer as in station 31. Although the roughened skive 37 is shown with respect to a counterclockwise moving sleeve 36, it is also usable with a clockwise moving sleeve and a stationary sleeve. The latter is shown in FIG. 3.

Figure 2:
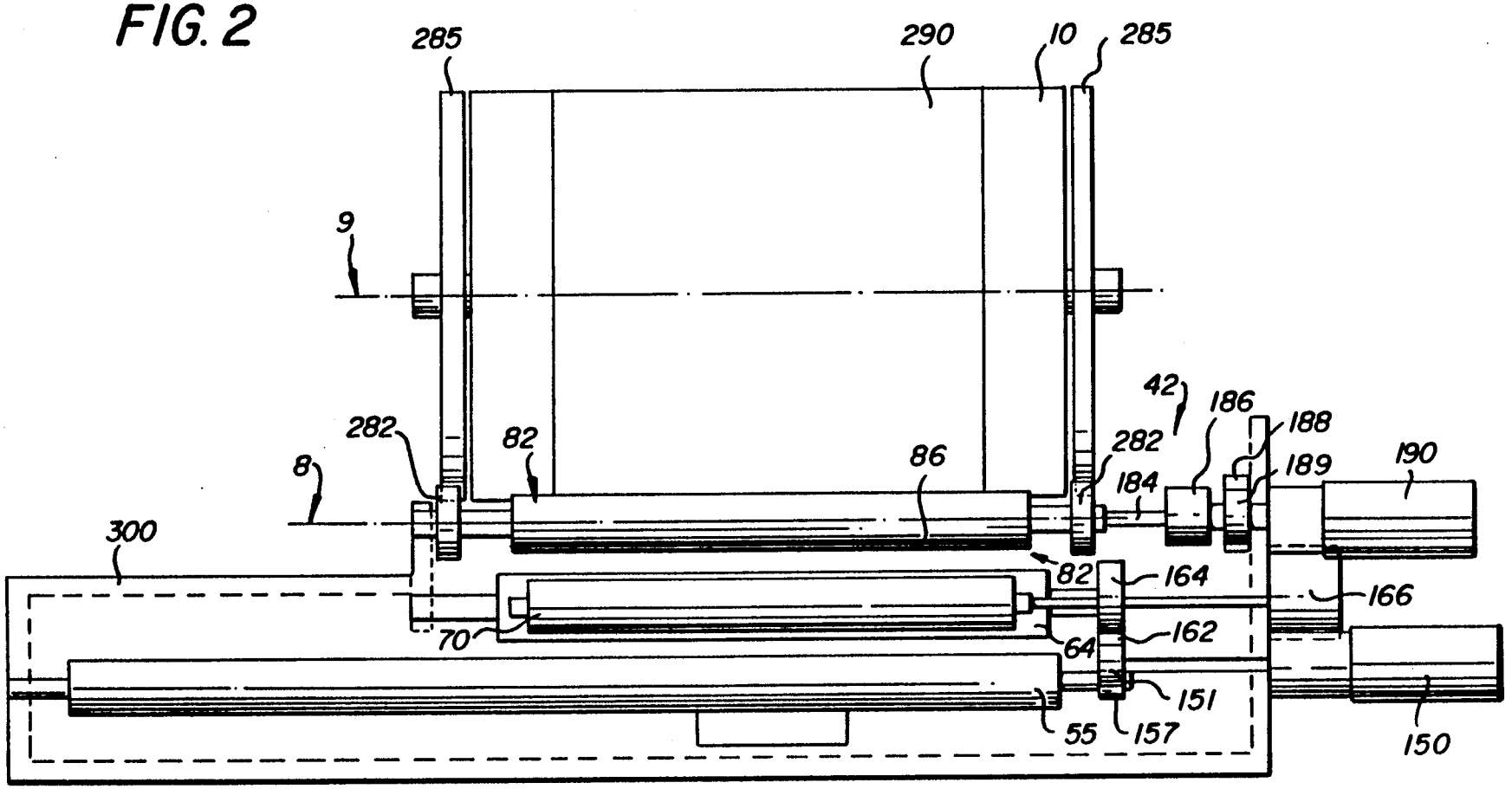
FIG. 2 is a side schematic of a portion of the apparatus shown in FIG. 1 with a portion of a single toning station shown with many parts not shown for clarity of illustration.
Figure 5:
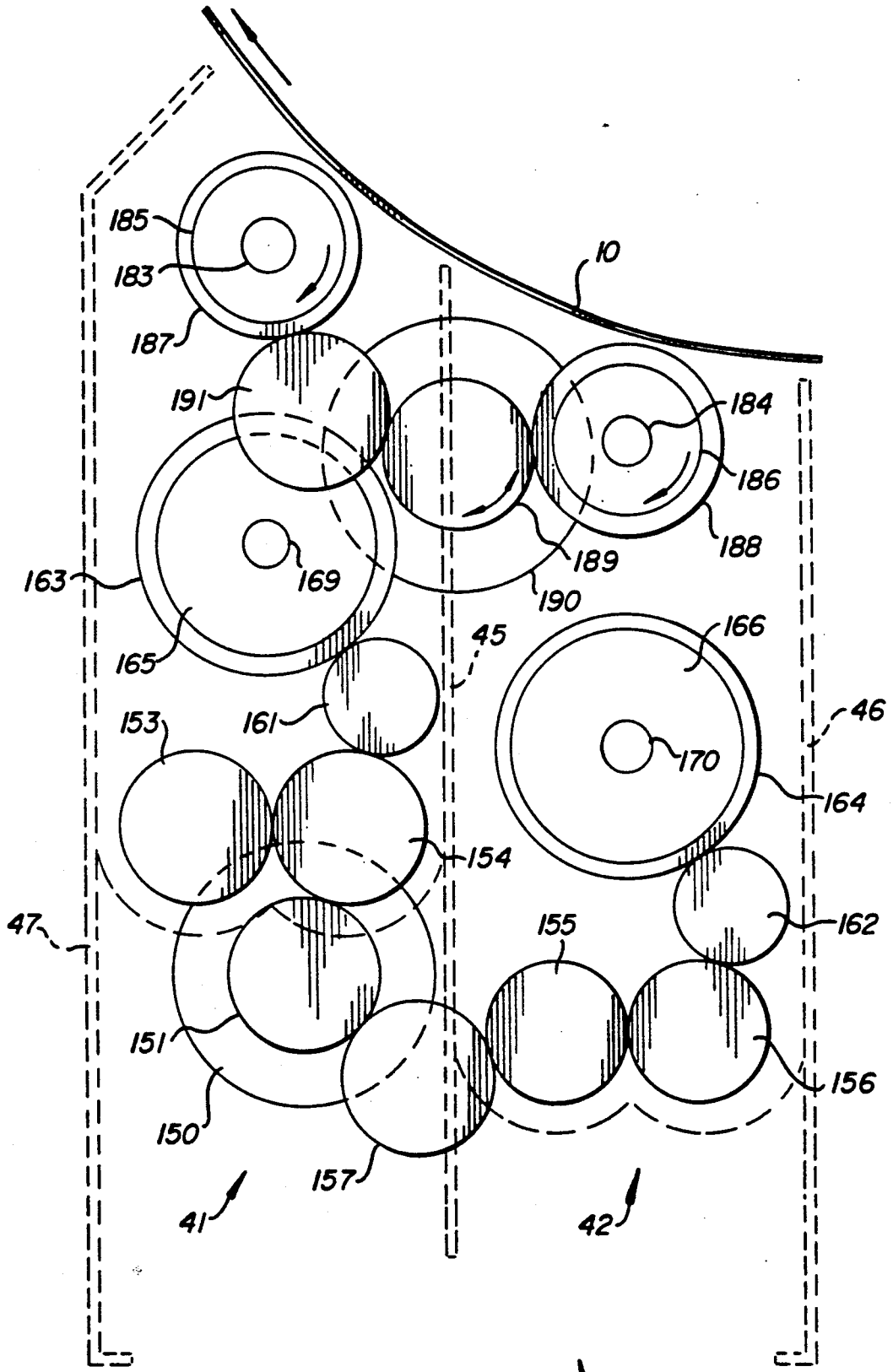
FIG. 5 is a gearing schematic of the toning unit shown in FIGS. 3 and 4 illustrating its drive mechanism.

FIG. 5 is a schematic illustrating the drive and control elements for the components described with respect to FIG. 3. The drive and control elements for station 42 are also shown in FIG. 2. Rotatable cores 83 and 84, shown in FIG. 3, are driven by shafts 183 and 184 shown in FIG. 5. Shaft 183 is driven through a one-way clutch 185 by a driven gear 187. Similarly, and as shown in both FIGS. 2 and 5, shaft 184 is driven through a one-way clutch 186 by a driven gear 188. Driven gear 188 is directly engaged by a drive gear 189 which, in turn, is driven by a reversible motor 190. Driven gear 187 is driven by idler gear 191 which, in turn, is also driven by drive gear 189 and reversible motor 190.

Preferably, developer is moved around sleeves 85 and 86 in a counterclockwise direction so that it is moving in the same direction as the electrostatic image it is toning at the toning positions 87 and 88. One-way clutches 185 and 186 permit rotation of shafts 184 and 185 only in a clockwise direction. Thus, when motor 190 drives drive gear 189 in a counterclockwise direction, it rotates driven gear 188 in a clockwise direction, driving shaft 184 and core 84 through one-way clutch 186, also in a clockwise direction to drive developer through development position 88. During this motion, gear 187 is driven in a counterclockwise direction. Because of one-way clutch 185, shaft 183 and core 83 are not driven at this time.

When motor 190 is reversed, it rotates drive gear 189 in a clockwise direction to, in turn, rotate idler gear 191 in a counterclockwise direction. Idler gear 191 drives driven gear 187 in a clockwise direction to drive shaft 183 and core 83 in a clockwise direction through one-way clutch 185. During this motion, gear 188 is driven in a counterclockwise direction but, because of one-way clutch 186, does not drive shaft 184 or core 84 at all.

Thus, a single motor 190 is able to selectively drive either core 83 or core 84 in its appropriate direction according to the direction that motor 190 is driven. If neither station 41 nor station 42 is to tone at a particular time, for example, while an image is passing that has been toned by one of stations 31 or 32, motor 190 is off.

Mixers 53, 54, 55 and 56 (FIG. 3) are all driven by a single motor 150 (FIGS. 2 and 5) through a drive gear 151 which directly drives driven gears 153 and 154 connected to mixers 53 and 54 and drives driven gears 155 and 156 through an idler 157. The same one-way clutch and reversible motor system applied to the applicators 81 and 82 could be also applied to mixing devices 53, 54, 55 and 56. However, it is preferable to continue mixing as long as the image forming apparatus is being used to assure continual charging and uniform mixing of the developer. Therefore, motor 150 is continuously driven, and no one-way clutches are used in driving the mixers in the FIG. 3 apparatus.

Transport rollers 63 and 64 are also continuously driven by motor 150 through driven gears 163 and 164 and idlers 161 and 162 which engage driven gears 154 and 156, respectively.

Movement of magnetic gates 69 and 70 between their positions shown with respect to stations 41 and 42 in FIG. 3 is accomplished by a pair of rotary solenoids 165 and 166 through shafts 169 and 170 that are common both to the solenoids and gates 69 and 70, respectively.

Figure 4:
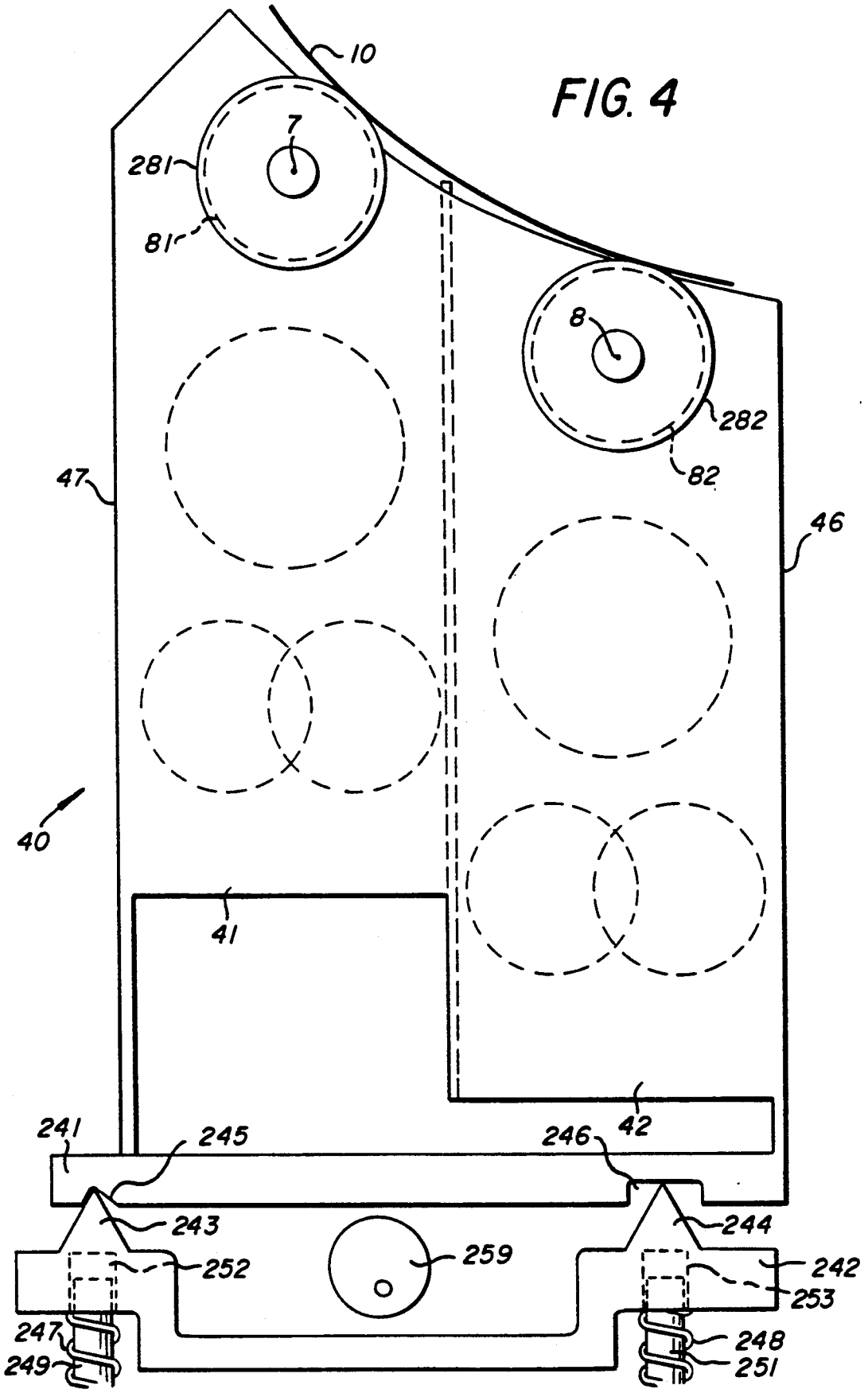
FIG. 4 is a side view partly in section of the unit shown in FIG. 3 and illustrating the positioning components of the unit.

FIG. 4 illustrates the advantage of toning unit 40 in accurately positioning stations 41 and 42 with respect to image member 10. According to FIG. 4, disks 281 and 282 are mounted concentrically with axes 7 and 8 of applicators 81 and 82. Identical disks are also mounted at the opposite ends of the applicators. Disks 281 and 282 are sized to have a radius measured from axes 7 and 8 equal to the outside radius of shells 85 and 86 plus the desired spacing between shells 85 and 86 and the image surface of image member 10.

If axes 7 and 8 are parallel to each other in toning unit 40 and toning unit 40 is pushed generally in an upward direction by a lifting device, as illustrated schematically by urging means 43 in FIG. 1, and the orientation of walls 46 and 47 is not restricted, then all four disks 281 and 282 will engage image member 10, and the axes 7 and 8 will be parallel to the axis 9 of image member 10. If the axes 7 and 8 are parallel to the axis 9 and the disks 281 and 282 are the same size, then the spacings between applicators 81 and 82 and the image surface will be the desired amount and will be constant across the image surface.

The orientation of walls 46 and 47 is determined by the vertical spacing between axes 7 and 8. This vertical spacing between axes 7 and 8 is chosen in FIG. 1 to cause walls 46 and 47 to also be vertical and parallel to the comparable walls on toning unit 30. This allows the four stations to be positioned generally parallel to each other as shown in FIG. 1. This vertical distance between axes 7 and 8 is not a critical dimension and can be accomplished with relatively less demanding tolerances providing the directional relation of the axes is maintained.

The preferred lifting mechanism for moving the toning unit 40 vertically upward until disks 281 and 282 engage image member 10 is shown in FIG. 4. According to FIG. 4, a bottom member 241 is positioned at each end of unit 40. A caming shoe 242 has protrusions 243 and 244 which engage indentations 245 and 246 in member 241. Indentation 246 is broad laterally so that the lateral position of unit 40 is determined by indentation 245. Lift springs 247 and 248 around guide pins 249 and 251 urge caming shoe 242 upward with respect to pins 249 and 251 which pins slide in holes 252 and 253 in shoe 242.

A control cam 259, shown in an inactive position with the unit 40 in an up position can be rotated to lower shoe 242 which permits unit 40 to move downward away from image member 10 under force of gravity. Alternatively, shoe 245 and member 241 can be spring urged together to actively force unit 40 to follow shoe 242.

Note that protrusions 243 and 244 are laterally outside of the contact points between disks 281 and 282 and the positioning surfaces, and each protrusion is being urged by its own spring 247 or 248 which is aligned with it. This arrangement assures contact of each of the four disks with the positioning surfaces, assuring proper spacing of the applicators.

FIG. 4 shows disks 281 and 282 riding on a portion of the image member 10 outside the portion used for imaging which portion becomes a positioning surface for disks 281 and 282. With such a structure, disks 281 and 282 are rollers which rotate on the positioning surface as it moves with the image member. However, a preferred form of this portion of the apparatus is better seen in FIG. 2. In FIG. 2, station 41 is broken away showing the inside of station 42 with many parts eliminated for clarity. In this embodiment, disks 282 are not rotatable and rest on an also not rotatable pair of large disks 285 at opposite ends of image member 10. Large disks 285 are each machined to have a cylindrical positioning surface coaxial with image member 10 and having the same diameter as the image surface of image member 10. Large disks 285 do not rotate with image member 10 and, thus, disks 282 do not have to rotate. Disks 285 are made to be full cylinders so that other stations can be positioned using their positioning surfaces. However, for positioning the toning stations alone they do not have to be full cylinders.

Similarly, disks 281 and 282 do not have to be cylindrical since they do not rotate. According to a preferred embodiment they are elliptical or eccentrically mounted and rotationally adjustable to allow a factory or field adjustment of the spacing between the applicator and the image surface. For example, the spacing between the image surface and the applicators can be adjusted between 0.010 and 0.020 inches with an appropriately shaped elliptical disk.

Referring again to FIG. 4, note that the unity of toning stations 41 and 42 in the toning unit 40 allows the use of a much simpler positioning device in disks or rollers 281 and 282 than is possible in structures in which two stations are not combined into a single unitary unit, for example, structure in which four rollers are positioned to the sides of each applicator. Because the rollers have to be positioned accurately with respect to the applicator in such multiroller devices, the structure shown in FIGS. 4 and 1 is much easier with which to maintain tolerances. Thus, not only is this approach to positioning unit 40 far more simple, it is also more accurate when produced in quantity.

For ease in maintaining tolerances, disks or rollers 281 and 282 are preferably coaxial with applicators 81 and 82, although they could be mounted on another axis having a fixed spacial relation with the surface of the applicator in toning positions 87 and 88. Further, if cores 83 and 84 have different axes from sleeves 85 and 86 (a known construction), it is preferable (although not necessary) that disks or rollers 281 and 282 be mounted coaxial with sleeves 85 and 86 for highest accuracy.

The toning unit 30 is mounted in exactly the same manner as the toning unit 40 except that the parts are a mirror image of those in the toning unit 40. As mentioned above, this allows essentially the same parts to be used for both toning units.

Although the structure illustrated in FIG. 4 is most useful in providing an accurate and constant gap or spacing between an applicator and an image surface, it can also be used in known development devices in which the applicator contacts the image surface. In this instance, parallel axes are also important and the rollers or disks can control the amount of such contact.

FIG. 2 also illustrates another embodiment of the FIG. 1 apparatus. According to FIG. 2, the image surface is, in fact, the outer surface of a web 290 which has been stretched around the outside cylindrical surface of image member 10 to provide a cylindrical or drum-shaped image surface. Note also in FIG. 2 that unit 42 has a portion 300 extending well beyond the end of image member 10. This extended portion contains the mixers 55 and 56 and can receive toner from toner bottles mounted above it.

FIG. 1 also illustrates an interior modification of the toning stations. According to FIG. 1, transport devices 62 and 63 are eliminated, and paddle mixing devices 253 and 254 are directly below an applicator 181. The flow of developer is shut off in this embodiment by stopping the rotation of mixing devices 253 and 254 which lowers the level of developer in the development chamber to a position at which it is no longer attractive to the magnetic core of applicator 181. This approach to terminating the flow of developer provides a more simple construction than that shown in FIGS. 3–6. However, it is not as quick in gating the developer flow. For that reason, the structure shown in FIGS. 3–6 is preferred for high speed imaging.

Although the toning stations herein are described with respect to a multicolor image-forming apparatus in which each frame contains a different color toner image and in which formation of the multicolor image is by registration of the toner images at transfer, aspects of this structure can be used in any other apparatus in which two toning stations are used. For example, it is known to sequentially form and tone electrostatic images on the same frame using different color toners. In this instance, the image member needs to have a circumference equal to at least the size of a frame, and each electrostatic image is formed on a different revolution of the drum using a laser or other exposing means. The toning means for such a system can be substantially as described herein, and all aspects of the invention would be advantageous in such an application.

The invention has been described in detail with particular reference to a preferred embodiment thereof, but it will be understood that variations and modifications can be effected within the spirit and scope of the invention as described hereinabove and as defined in the appended claims.

We claim:

1. An image-forming apparatus comprising:

a first development station having a first applicator for applying toner to an electrostatic image, a second development station having a second applicator for applying toner to an electrostatic image, and a reversible motor connected to said first and second applicators through first and second connecting means, respectively, said first and second connecting means driving only the first applicator when said motor is driven in a forward direction and only the second applicator when said motor is driven in a reverse direction.

2. Image-forming apparatus according to claim 1 wherein said first connecting means includes a first one-way clutch preventing rotation of said first applicator when said motor is being driven in its reverse direction and said second connecting means includes a second one-way clutch preventing rotation of said second applicator when said motor is being driven in its forward direction.

3. Image-forming apparatus according to claim 1 wherein said first and second connecting means include a common drive means coaxial with said reversible motor, and said first connecting means includes a driven gear coaxial with said applicator and directly engaging said drive means, and said second connecting means includes an idler gear directly engaging said drive means and a second driven gear coaxial with said applicator and engaging said idler gear, said driven gears driving said applicators when driven by said motor.

4. Image-forming apparatus according to claim 3 wherein each of said connecting means includes a one-way clutch drivingly positioned between its driven gear and its corresponding applicator.

5. Image-forming apparatus according to claim 1 wherein each applicator includes a rotatable magnetic core and a non-magnetic sleeve around said core which rotatable magnetic core rotates in response to appropriate actuation of said motor to drive developer along said non-magnetic sleeve through toning relation with an electrostatic image carried on an image member.

6. A multicolor image-forming apparatus comprising:

an image member movable through a path past a series of stations, means for forming an electrostatic image on said image member, means for selectively applying toner of either of two colors to said electrostatic image, said means including, first development station having a first applicator having a rotatable component for moving a developer having a toner of a first color in a toner applying direction through toning relation with an electrostatic image, a second toning station having a second applicator having a rotatable component for moving developer having a toner of a second color different from the first color in a toner applying direction through toning relation with an electrostatic image on said image member, a reversible motor connected to both rotatable components through first and second connecting means, respectively, said first connecting means driving the first rotatable component when said motor is driven in a forward direction and said second connecting means driving the second rotatable component when said motor is driven in the reverse direction.

7. Image-forming apparatus according to claim 6 wherein said first and second connecting means each include a one-way clutch to prevent rotation of said rotatable component in a direction reverse to its toner applying direction.

* * * * *